United States Patent [19]

Raab et al.

[11] Patent Number: 4,766,278

[45] Date of Patent: Aug. 23, 1988

[54] SEALED TOGGLE ACTION ELECTRICAL SWITCHES

[75] Inventors: Andrew F. Raab, Morton Grove; John W. Habecker, Zion, both of Ill.

[73] Assignee: Indak Manufacturing Corp., Northbrook, Ill.

[21] Appl. No.: 803,491

[22] Filed: Dec. 2, 1985

[51] Int. Cl.[4] ..... H01H 1/52

[52] U.S. Cl. ..... 200/327; 200/260; 200/275; 200/291

[58] Field of Search ..... 200/327, 153 G, 252, 200/253, 255, 260, 275, 279, 290, 291, 16 C, 334, 339, 335

[56] References Cited

U.S. PATENT DOCUMENTS

| | | | |
|---|---|---|---|
| 2,356,521 | 8/1944 | Kochner | 200/291 |
| 3,235,679 | 2/1966 | Schaad et al. | 200/16 C |
| 3,299,227 | 1/1967 | Schaad et al. | 200/291 |
| 3,643,051 | 2/1972 | Foley | 200/339 |
| 4,168,405 | 9/1979 | Raab et al. | 200/16 C |
| 4,331,849 | 5/1982 | Wolf | 200/16 C |
| 4,389,552 | 6/1983 | Sorenson | 200/68.3 |
| 4,506,119 | 3/1985 | Tanabe | 200/253 |

*Primary Examiner*—Henry J. Recla
*Assistant Examiner*—Linda J. Sholl
*Attorney, Agent, or Firm*—Burmeister, York, Palmatier, Hamby & Jones

[57] ABSTRACT

The sealed toggle action switch comprises an operating lever having a front operating arm projecting out of the front component of the casing. The lever has a rear arm, projecting into the casing and carrying a contactor plate for relative sliding and swinging movement. A coil spring is received around the rear arm and is compressed between the contactor plate and the front sealing flange of a soft resilient sealing boot, such sealing flange being compressed against the operating lever. The boot has a rear, outwardly projecting sealing flange which is retained between the front and rear casing components. The contactor plate has a pair of J-shaped flanges which are slidably engageable with first and second fixed contacts having forwardly projecting protuberances, affording a detent action with the J-shaped flanges. In one position of the operating lever, the J-shaped flanges of the contactor plate engage both of the first and second contacts. In the second positon of the operating lever, one of the J-shaped flanges is held out of engagement with the second contact by a pair of insulating ramps on the rear casing component. The first fixed contact preferably comprises a contact plate having forwardly projecting contact flanges affording protuberances or humps, over which one of th J-shaped flanges is movable when the contactor plate is moved between its first and second positions. In one position of the operating lever, the front operating arm is adapted to retain the end fitting of a safety lanyard. In this position, the front arm engages tabs which assist in retaining the end fitting of the lanyard.

4 Claims, 7 Drawing Sheets

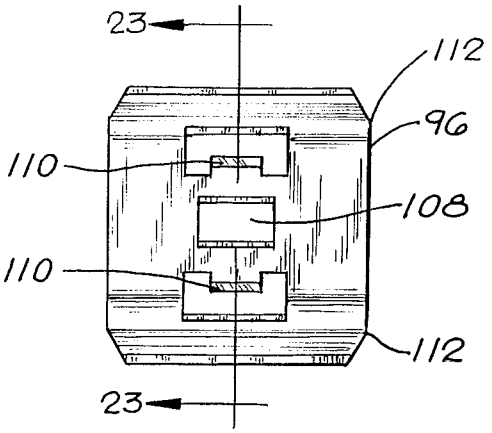
FIG. 21
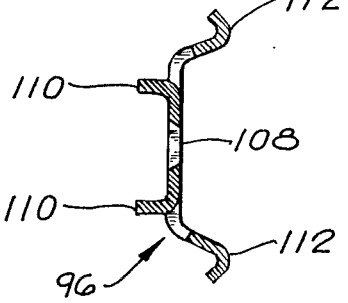
FIG. 23
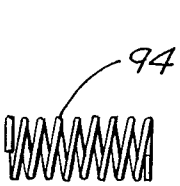
FIG. 24
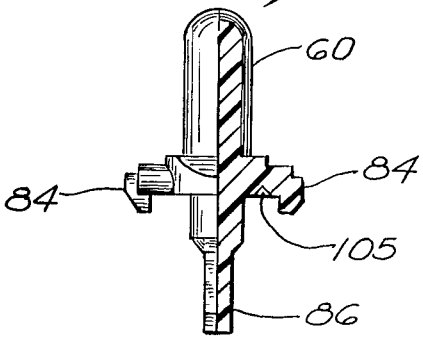
FIG. 28
FIG. 22
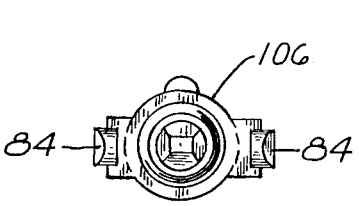
FIG. 27
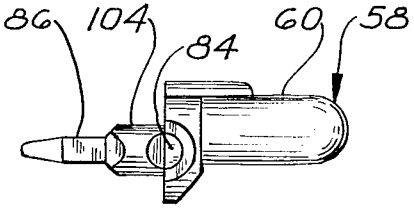
FIG. 25
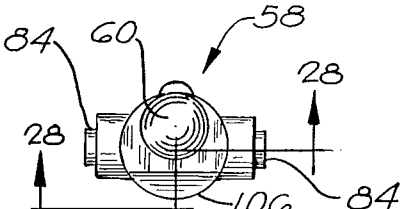
FIG. 26
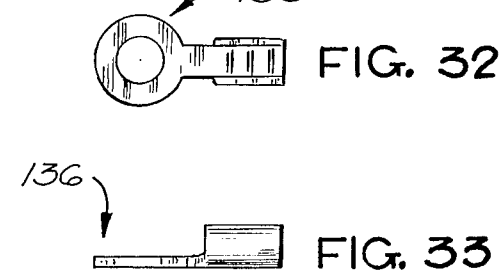
FIG. 33
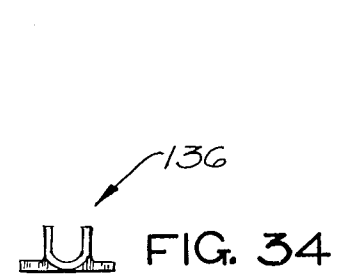
FIG. 34
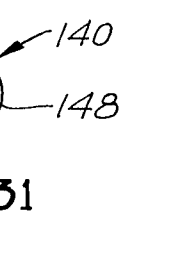
FIG. 31
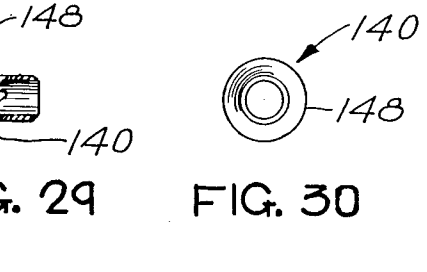
FIG. 29
FIG. 32
FIG. 30

SEALED TOGGLE ACTION ELECTRICAL SWITCHES

FIELD OF THE INVENTION

This invention relates to toggle action, lever-type electrical switches which are fully sealed against the entry of water or other foreign materials. The switches of the present invention are particularly well adapted for marine use, in connection with outboard motors or other marine motors, to perform a shutoff function. However, the switches will find other applications.

BACKGROUND OF THE INVENTION

ON-OFF switches of various constructions have previously been used in connection with outboard boat motors or the like, to perform a shutoff function. When a switch of this type is in its ON or RUN position, the motor can be started and will run. When the switch is operated to its OFF position, the ignition system for the motor is disabled, so that the motor stops. In many cases, the switch short-circuits a portion of the ignition system, so that no spark voltage is supplied to the spark plug or plugs of the motor. When this is the case, the switch is closed in its OFF position, while being open in its ON or RUN position.

In the operation of a motor boat, there is a significant hazard that the operator may accidentally fall overboard. Similar hazards exist as to other vehicles, such as snowmobiles, in that the operator may accidentally fall off the vehicle, while it is in motion. To deal with this hazard, it has been the practice in some cases to provide a motor shutoff switch which is adapted to be operated to its OFF position by a safety lanyard or line, connected between the switch and some portion of the operator's body or clothing. In the case of a boat, if the operator falls overboard, the lanyard pulls loose from the switch, and thereby operates the switch to its OFF position. In this way, the boat motor is stopped, so that the operator can swim to the boat, and is in no danger of being run down by the unattended boat.

The present invention is directed to the problem of producing a new and improved shutoff switch which has the virtues of being especially well adapted for use with boat motors, and in similar applications, while also being extremely sturdy, highly reliable in operation, fully sealed against the entry of water, well adapted for use with a safety lanyard, and inexpensive in construction.

SUMMARY OF THE INVENTION

One object of the present invention is to provide a new and improved electrical switch having an operating lever which affords a toggle action, so that the lever snaps between its ON and OFF positions.

Another object is to provide such a new and improved switch which is well adapted for use with a safety lanyard, so that the switch will be operated to its OFF position if the safety lanyard is pulled loose from the switch.

A further object is to provide such a new and improved switch which is fully sealed against the entry of water and other foreign materials.

Still another object is to provide such a new and improved switch which affords a long operating life and is extremely sturdy and highly reliable in operation, yet is inexpensive in construction.

To achieve these and other objects, the present invention may provide a toggle action electrical switch, comprising a casing, an electrically insulating operating lever swingable in the casing, the lever having an outer arm projecting out of the casing and an inner arm projecting into the casing, an electrically conductive electrical contactor slidable along the inner arm and swingable relative to the inner arm, first and second fixed electrical contacts mounted in the casing and slidably engageable by the contactor, such contactor being movable with the lever between a first position in which the contactor bridges electrically between the contacts and a second position in which the contactor does not bridge electrically between the contacts, a spring acting between the lever and the contactor for biasing the contactor toward the contacts, and detent means for detaining the contactor in its first and second positions, the lever having first and second positions corresponding to the first and second positions of the contactor, the spring producing a toggle action for resiliently resisting movement of the lever between its first and second positions while resiliently biasing the lever alternately into its first and second positions.

A flexible resilient sealing boot, made of rubber or a rubber-like material, is preferably interposed between the operating lever and the casing. The boot preferably has a sealing flange which is retained between front and rear components of the casing, to afford a seal therebetween. The rear casing component preferably has a forwardly projecting bead, engaging the flange and establishing a continuous seal therewith. The front and rear casing components preferably have latching or other connecting means for connecting the components together, with the sealing flange clamped therebetween.

The boot preferably has a second sealing flange which is pressed by the spring against a portion of the operating lever, to maintain a seal between the boot and the lever. Preferably, the second flange on the boot is formed with an annular bead which is pressed into sealing engagement with an annular V-groove on the lever. The spring is preferably in the form of a coil spring, received around the inner or rear arm of the operating lever, and acting compressively between the lever and the electrical contactor. The spring is additionally compressed as the lever is moved between its two positions, so that the lever snaps between such two positions.

The contactor is preferably in the form of a contactor plate having a slot therein for slidably receiving the inner or rear arm of the operating lever. The slot is oversize and thus affords a loose fit with the inner arm to provide for relative swinging movement between the inner arm and the contactor plate.

The detent means may preferably include formations on the contactor plate and on the fixed contacts. The detent formations on the contactor plate preferably include first and second rearwardly projecting J-shaped flanges thereon for slidably engaging the fixed contacts. The detent formations on the fixed contacts preferably comprise forwardly projecting protuberances or humps for detaining the J-shaped flanges in the first and second positions of the contactor plate. The first and fixed contact preferably comprises a member with a pair of forwardly projecting flanges having forwardly projecting humps thereon slidably engageable by the first J-shaped flange on the contactor plate. The first J-shaped flange is slidable over such humps in moving with the contactor plate between its first and second positions, whereby such humps afford a detent action. The forwardly projecting flanges are slidably engaged by the first J-shaped flange throughout the range of movement of the contactor plate.

The second fixed contact preferably comprises a forwardly projecting contact point engageable by the second J-shaped flange when the contactor plate is in its first position, in which the contactor plate bridges electrically between the first and second contacts.

The casing may include an insulating ramp, and preferably includes a pair of insulating ramps for slidable engagement by the second J-shaped flange to hold such flange out of engagement with the contact point in the second position of the contactor plate, whereby such plate does not form an electrical bridge between the first and second contacts.

It is advantageous to provide resilient or yieldable detention of the contactor plate in its first and second positions, to prevent accidental movement of the contactor plate between its positions, and to maintain the contactor plate in either position, against any possible displacement due to vibration or shock. Nevertheless, the detention is of a moderate character, so that the operating lever of the switch can be moved between its two positions with ordinary effort.

The forwardly projecting flanges on the first fixed contact are very advantageous, in that they afford such moderate detention of a smooth character, while keeping the contactor plate in its desired orientation along its desired operating path, even though the switch may be subjected to unusual shock or abuse. The insulating ramps on the casing also control the movement of the contactor plate and enhance the ability of the switch to withstand unusual shock or abuse.

The fixed contacts of the switch have terminals which preferably are embedded in a sealing or potting composition, to exclude water and other foreign materials.

BRIEF DESCRIPTION OF THE DRAWINGS

Further objects, advantages and features of the present invention will appear from the following description, with reference to the accompanying drawings, in which:

FIG. 21 is a front elevation of the contactor plate for the switch.

FIG. 22 is a plan view of the contactor plate.

FIG. 23 is a section, taken generally along the line 23—23 in FIG. 21.

FIG. 24 is an elevation of the coil spring for the switch.

FIGS. 25 and 26 are side and front elevations of the operating lever for the switch.

FIG. 27 is a rear elevation of the operating lever.

FIG. 28 is a section, taken generally along the line 28—28 in FIG. 26.

FIG. 29 is an elevational view, partly in section, of an eyelet for use on each of the leads for the switch.

FIGS. 30 and 31 are opposite and views of the eyelet.

FIGS. 32, 33 and 34 are rear, side and end views of terminals for connecting the leads to the fixed contacts of the switch.

DETAILED DESCRIPTION OF ILLUSTRATIVE EMBODIMENTS

Figure 1:
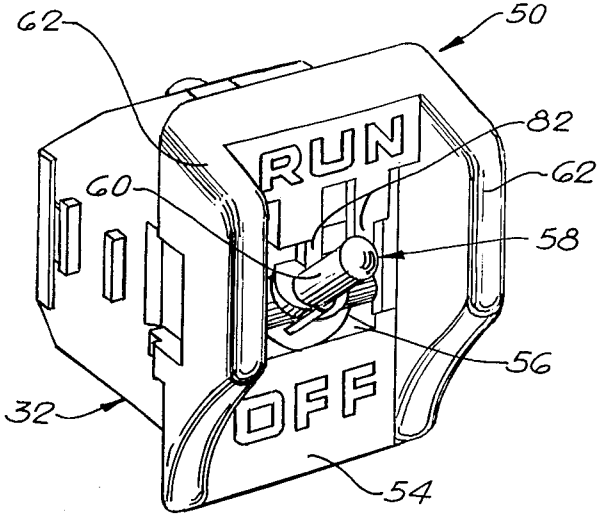
FIG. 1 is a perspective view of a sealed toggle action electrical switch, to be described as an illustrative embodiment of the present invention.
Figure 2:
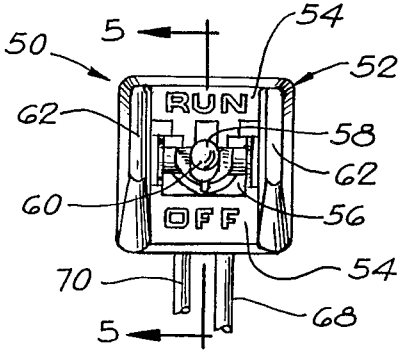
FIG. 2 is a front elevation of the switch.
Figure 4:
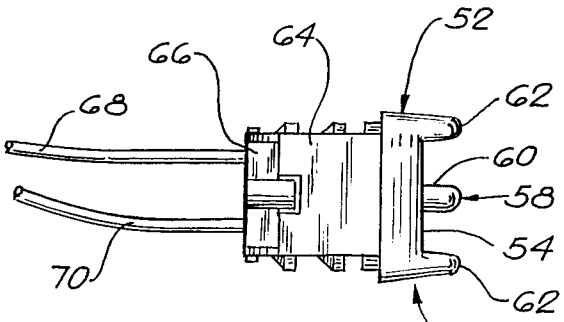
FIG. 4 is a plan view of the switch.
Figure 3:
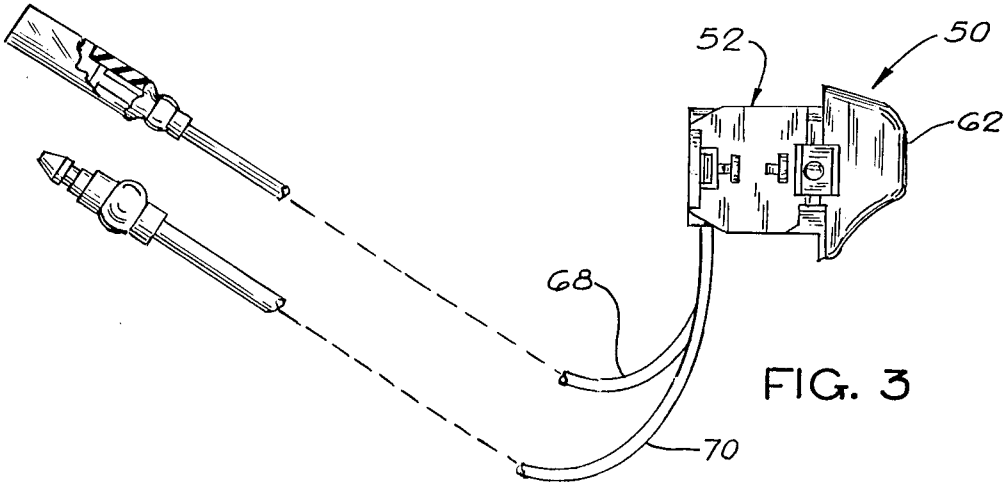
FIG. 3 is a side elevation.

FIGS. 1–5 illustrate the outward appearance of a sealed toggle action electrical switch 50, to be described as an illustrative embodiment of the present invention. The illustrated switch 50 has a casing 52, preferably made of a suitable electrically insulating resinous plastic material which is strong, resilient, intricately moldable and resistant to heat. The casing 52 is generally in the form of a hollow rectangular box, having a front wall 54 with an opening 56 therein. The switch 50 has a swingable electrically insulating resinous plastic operating lever 58, including a front or outer operating arm 60 which projects forwardly, outside the casing 52, through the opening 56. The arm 60 is swingable downwardly to its OFF position and upwardly to its RUN or ON position. The corresponding legends OFF and RUN appear on the front wall 54.

In this instance, the casing 52 has a pair of forwardly projecting vertical guard flanges 62, on opposite sides of the operating arm 60, to protect the arm against accidental operation.

The illustrated casing 52 has front and rear components 64 and 66 which are telescopically engaged and are latched or otherwise connected together. Electrical leads or wires 68 and 70 extend out of the rear component 66 of the casing 52.

Figure 5:
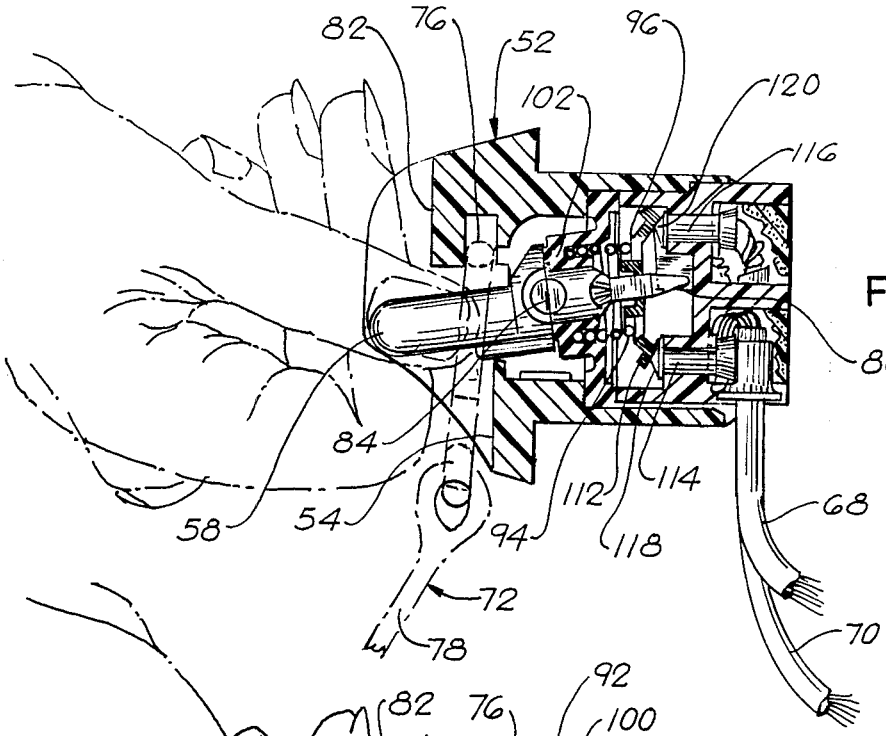
FIG. 5 is an enlarged elevational section, taken generally along the line 5—5 in FIG. 2 and showing the switch in its OFF position, which is the closed position in this instance.
Figure 6:
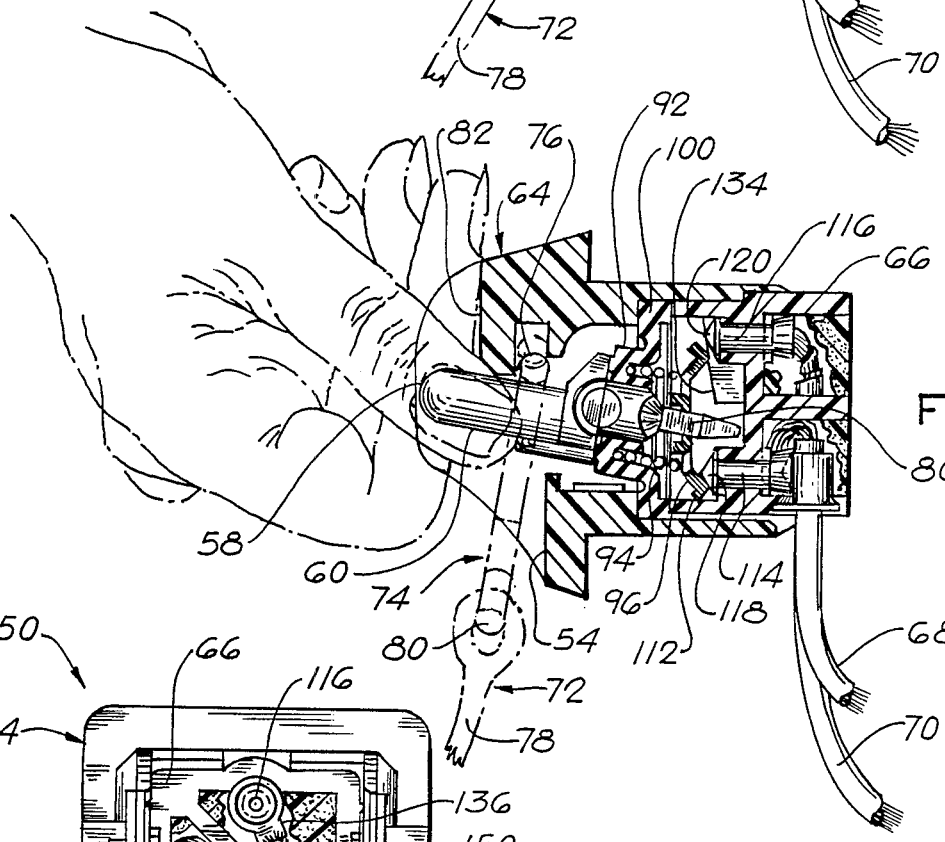
FIG. 6 is a view similar to FIG. 5, but showing the switch in its ON position, which is the open position in this instance.
Figure 6A:
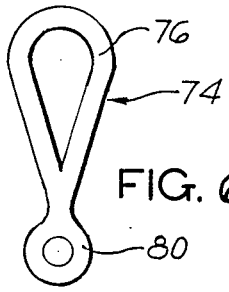
FIG. 6A is an elevational view of a safety lanyard fitting, adapted to be received on the operating lever of the switch, whereby the lever will be moved to its OFF position if the lanyard is pulled loose from the switch.
Figure 9:
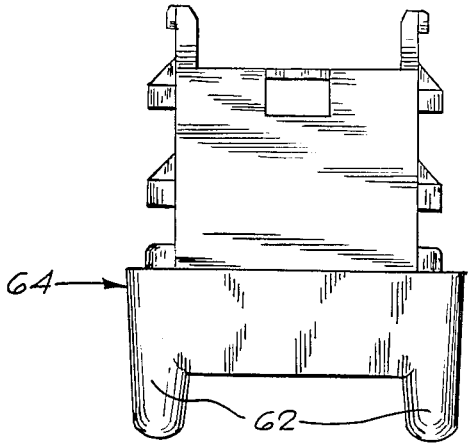
FIG. 9 is a plan view of the front casing component.
Figure 10:
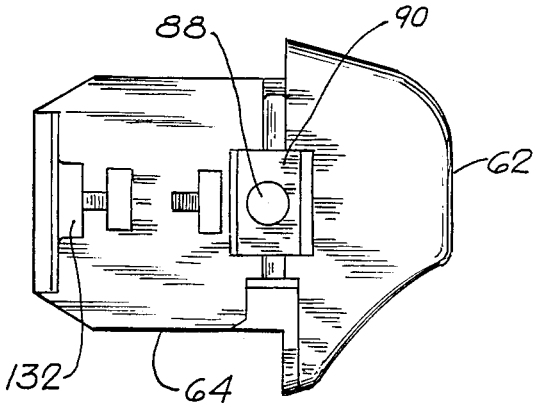
FIG. 10 is a side elevation of the front casing component.
Figure 8:
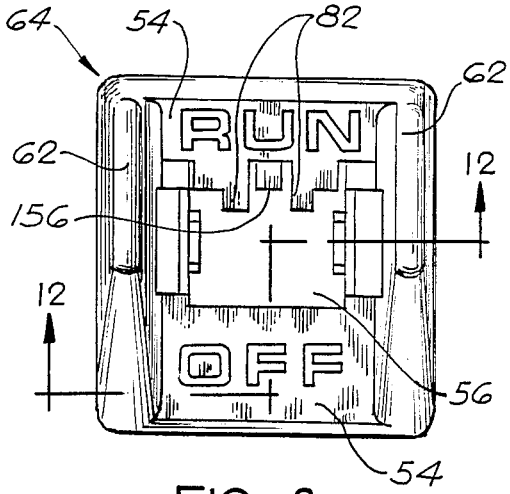
FIG. 8 is an enlarged front elevation showing the front casing component of the switch.

As shown in FIGS. 5, 6 and 6A, the front or outer arm 60 of the operating lever 58 is adapted to be connected to one end of a safety lanyard 72 having an end fitting 74 including a loop 76, slidably receivable around the arm 60. The lanyard 72 also includes a cord or line 78, received in a smaller loop 80 on the end fitting 74. When the operating arm 60 is swung downwardly to its OFF position, as shown in FIG. 5, the loop 76 of the end fitting 74 can be slipped around the arm 60 and guided behind a pair of retaining tabs or flanges 82, projecting downwardly from the upper portion of the casing 52, and spaced forwardly from the front wall 54. When the operating arm 60 is swung upwardly to its RUN position, as shown in FIG. 6, the arm 60 engages the flanges 82, so that the loop 76 is held captive on the arm 60. However, if any substantial pull is exerted on the line 78 of the lanyard 72, the operating arm 60 is swung downwardly by such pull to the OFF position of the arm 60, as shown in FIG. 5, so that the loop 76 can easily be pulled off the arm 60. The opposite end of the cord or line 78 is intended to be connected to some portion of the body or clothing of the operator, so that the lanyard 72 will be pulled loose from the operating arm 60, if the operator accidentally falls overboard from the boat or other vehicle. When the lanyard 72 is pulled loose, the operating arm 60 of the switch 50 is automatically swung downwardly to the OFF position of the switch, so that the boat motor is stopped. In this way, the operator can easily swim to the boat, and is in no danger of being run down by the unattended boat.

As shown in FIGS. 25–27, and also in FIGS. 5 and 6, the operating lever 58 has a pair of pivots 84, extending in opposite lateral directions from the lever 58, and a rear or inner arm 86, projecting rearwardly into the casing 52. The pivots 84 snap into pivot openings 88, formed in opposite side wall portions 90 of the front casing component 64, which is generally box-like in shape, with an open rear. The side wall portions 90 have sufficient flexibility to provide for the insertion of the pivots 84.

The rear arm 86 of the operating lever 58 is adapted to receive a soft resilient rubber-like sealing boot 92, a compression coil spring 94 and an electrically conductive contactor 96, which is slidable along the rear lever arm 86. The assembled components are shown in FIGS. 5 and 6.

Figures 13, 14, 15, 16, 17, 18, 19, 20:
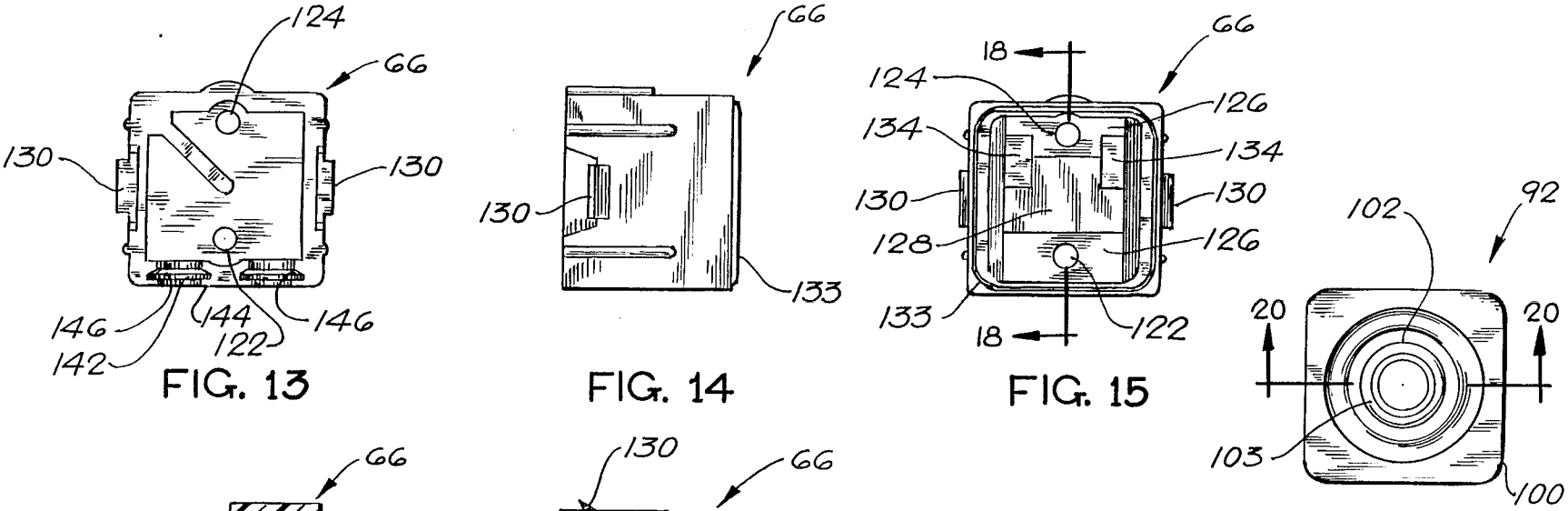
FIG. 13 is a rear elevation of the rear casing component.
FIGS. 14 and 15 are side and front elevations of the rear casing component.
FIGS. 16 and 17 are top and bottom plan views of the rear casing component.
FIG. 18 is a section, taken generally along the line 18—18 in FIG. 15.
FIG. 19 is a front elevation of the soft resilient sealing boot for the switch.
FIG. 20 is a section, taken generally along the line 20—20 in FIG. 19.
Figure 45:
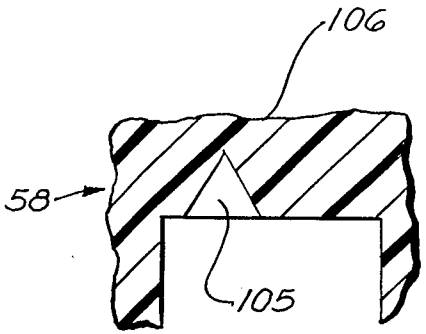
FIG. 45 is a fragmentary enlarged section, corresponding with a portion of FIG. 28.
Figure 46:
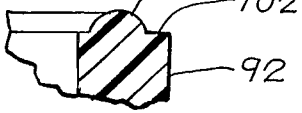
FIG. 46 is a fragmentary enlarged section, corresponding with a portion of FIG. 20.

As shown most clearly in FIGS. 19 and 20, the sealing boot 92 comprises a generally cylindrical sleeve 98 having a rear outwardly projecting flange 100 and a front inwardly projecting flange 102, which fits snugly around an enlarged cylindrical front portion 104 of the rear lever arm 86, while seating against a circular flange 106 on the operating lever 58. The coil springs 94 presses the front flange 102 of the boot 92 against the circular flange 106 on the lever 58. To provide a tight seal, the flange 102 includes an annular bead 103 which is pressed into sealing engagement with a V-shaped annular groove 105, formed in the circular flange 106 of the lever 58. See FIGS. 45 and 46.

As shown most clearly in FIGS. 25 and 27, as well as in FIGS. 5 and 6, the rear lever arm 86 is generally rectangular in cross section and is adapted to be slidably received in an oversize generally rectangular opening 108, formed in the contactor 96, which is generally in the form of an electrically conductive plate. The oversize opening or slot 108 provides for relative swinging movement between the rear lever arm 86 and the contactor plate 96. At the same time, the rectangular shape of the arm 86 and the opening 108 maintains the proper orientation between the contactor plate 96 and the arm 86.

The rear end of the coil spring 94 engages the front side of the contactor plate 96 and is embraced and located by a pair of forwardly projecting tabs 110 on the contactor plate 96. The coil spring 94 fits snugly, with a friction fit, between the tabs 110, so that the contactor plate 96 is frictionally retained on the rear end of the coil spring 94, to facilitate the assembly of the switch 50.

The contactor plate 96 is formed with first and second rearwardly projecting J-shaped flanges 112, which serve as contacting riders for the contactor plate 96, while also serving as detent elements.

In the embodiment of FIGS. 5 and 6, the switch 50 comprises first and second fixed contacts 114 and 116 having respective forwardly projecting protuberances or humps 118 and 120 which are slidably engageable by the J-shaped flanges 112 on the contactor plate 96. In FIGS. 5 and 6, the first and second fixed contacts 114 and 116 are illustrated as electrically conductive contact rivets having heads in the form of contact points, constituting the forwardly projecting protuberances of humps 118 and 120. The first and second fixed contacts 114 and 116 are mounted on and supported by the rear casing component 66, which fits telescopically into the front casing component 64. The first and second fixed contacts 114 and 116, considered specifically as contact rivets, extend through first and second openings 122 and 124 in a rear wall portion 126 of the rear casing component 66, as shown in FIG. 18. The rear wall portion 126 has a central recess 128, facing forward, to afford clearances for the rear lever arm 86.

Figure 40:
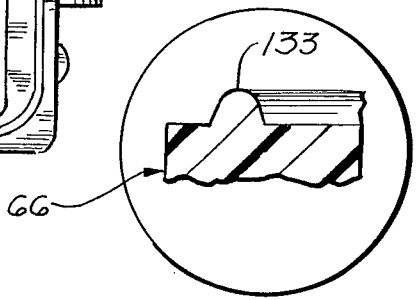
FIG. 40 is an enlarged fragmentary section, corresponding to the encircled portion of FIG. 39.
Figure 39:
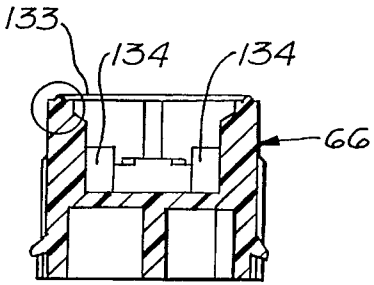
FIG. 39 is a section, taken generally along the line 39—39 in FIG. 38.

The front and rear casing components 64 and 66 have connecting means for connecting the components together, such connecting means being illustrated as comprising a pair of latching teeth 130, projecting laterally from the rear casing component 66, and adapted to snap into latching slots 132 in the front casing component 64. The outwardly projecting flange 100 of the boot is compressed between the front casing component 64 and a continuous sealing bead 133 on the front end of the rear casing component 66. See FIGS. 14, 15 and 40.

The operating lever 58 is movable between first and second positions, shown in FIGS. 5 and 6. The contactor plate 96 is correspondingly movable between the first and second positions of FIGS. 5 and 6. The first position is the OFF position, while the second position is the RUN position. In the first or OFF position, the contactor plate 96 forms an electrically conductive bridge between the forwardly projecting protuberances or contact points 118 and 120 of the first and second fixed contacts 114 and 116. In the second or RUN position of FIG. 6, the contactor 96 does not form a bridge between the contact points 118 and 120, because the corresponding J-shaped flange 112 of the contactor plate 96 is held out of engagement with the contact point 120 by insulating means, illustrated as a pair of insulating ramps 134 on the rear casing component 66, as shown most clearly in FIGS. 15 and 18, as well as in FIGS. 5 and 6.

When the contactor plate 96 is in its OFF position, as shown in FIG. 5, the J-shaped flanges 112 of the contactor plate engage the contact points 118 and 120, so that the contactor plate affords an electrically conductive bridge between the fixed contacts 114 and 116. When the contactor plate 96 is moved to its ON position, as shown in FIG. 6, one of the J-shaped flanges 112 moves over the forwardly projecting hump or protuberance, formed by the contact point 118, so that this J-shaped flange engages the opposite slope of the contact point 118. The movement of the J-shaped flange 112 over the contact point 118 produces additonal compression of the coil spring 94, so that there is a resilient detent action, tending to retain the contactor plate 96 in both its OFF and ON positions. When the contactor plate 96 is moved to its ON position, the other J-shaped flange 112 slides up the protuberance or hump formed by the contact point 120, and then slides down the insulating ramps 134, which hold this J-shaped flange away from the contact point 120, so that the contactor plate 96 does not form an electrically conductive bridge between the contact points 118 and 120. The slopes afforded by the contact point 120 and the ramps 134 additionally compress the coil spring 94, and thereby produce an additonal detent action, tending to detain the contactor plate 96 in both the OFF and ON positions.

Figure 7:
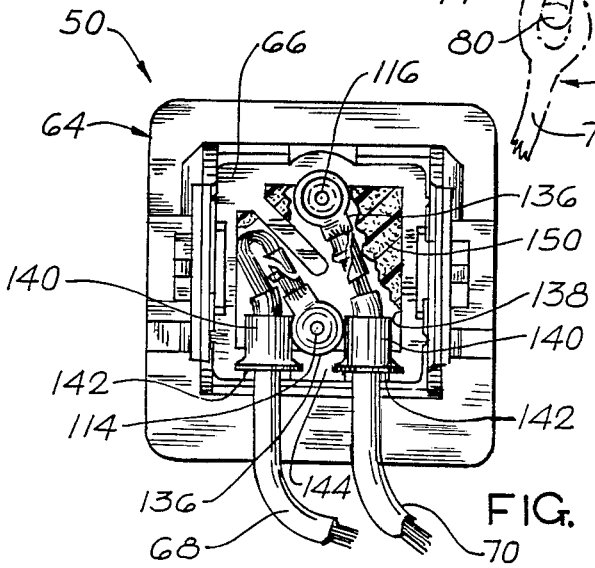
FIG. 7 is a rear elevation of the switch, showing the terminals and leads for the switch, with most of the potting composition broken away for clarity of illustration.

As shown most clearly in FIG. 7, termimals in the form of lugs 136 are employed to connect the electrical leads 68 to the rivets which constitute the first and second fixed contacts 114 and 116. The rear casing component 66 has a rearwardly facing recess or cavity 138 to accommodate the terminals 136. An shown in FIG. 7, strain relief eyelets 140 are crimped or otherwise secured to the leads 68 and 70 and are held captive in slots 142, extending through one wall portion 144 of the rear casing component 66. The slots 142 are formed with grooves 146 for receiving flanges 148 on the eyelets 140, whereby the eyelets are held captive. After all of the components have been assembled on the rear casing component 66, the entire recess 138 is filled with a sealing or potting composition 150, to exclude water and other foreign materials from the inside of the switch 50, while embedding the rear portions of the contact rivets 114 and 116, the terminals 136, the eyelets 140, and portions of the leads 68 and 70. The embedded components are securely anchored and immobilized in the rear casing component 66. The material 150 may take the form of an epoxy potting material, or any other suitable material.

Figure 11:
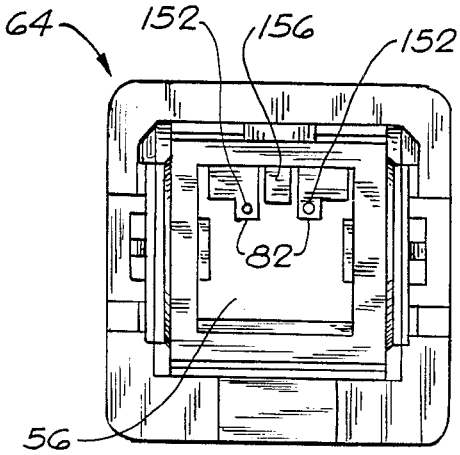
FIG. 11 is a rear elevation of the front casing component.
Figure 12:
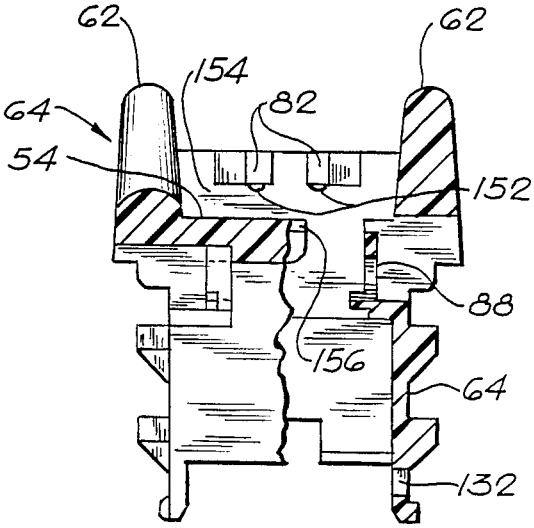
FIG. 12 is a section, taken generally along the broken line 12—12 in FIG. 8.

It will be recalled that the loop 76 of the end fitting 74 for the lanyard 72 is adapted to be received behind the downwardly projecting tabs or flanges 82. As shown most clearly in FIGS. 11 and 12, the tabs 82 are formed with rearwardly projecting detent points or bumps 152 which tend to detain the lanyard loop 76 in a space or slot 154 behind the tabs 82. The front casing component 64 has an ear 156 to the rear of the opening 154, to assist in detaining the lanyard loop 76.

However, if the lanyard 72 is pulled loose from the switch 50, the lanyard loop 76 is pulled out of the space 154 behind the tabs 82, so that the lanyard loop swings the switch operating arm 60 downwardly to its OFF position. The swinging movement of the switch lever 58 produces additional compression of the coil spring 94, so that there is a toggle action, whereby the switch lever 58 snaps between its ON and OFF positions.

FIGS. 35–44 illustrate a second illustrative embodiment, in the form of an improved toggle action electrical switch 160, which is very much the same as the switch 50, except that the first contact 114 of the switch 50 is replaced with an improved first contact construction 162, including a rivet 164 having a head 168 which is employed to secure a contact plate 170 to the rear casing component 66. As shown, the contact plate 170 has a pair of forwardly projecting contact flanges 172 which are slidably engageable by the corresponding J-shaped flange 112 of the contactor plate 96. The contact flanges 172 are formed with forwardly projecting protuberances or humps 174, having a detent action with the corresponding J-shaped flange.

In all positions of the contactor plate 96, the forwardly projecting contact flanges 172 are slidably engaged by the corresponding J-shaped flange 112 on the contactor plate. As the contactor plate 96 is moved between its RUN and OFF positions, the corresponding J-shaped flange 112 slides over the forwardly projecting humps 174, which thereby produce a detent action, tending to detain the contactor plate 96 in both positions.

The forwardly projecting contact flanges 172, with their forwardly projecting protuberances or humps 174, provide a smoother detent action, and more stable and secure support for the contact plate 96, than in the case of the previously described contact rivet 114 with its forwardly projecting contact point 118.

Figure 35:
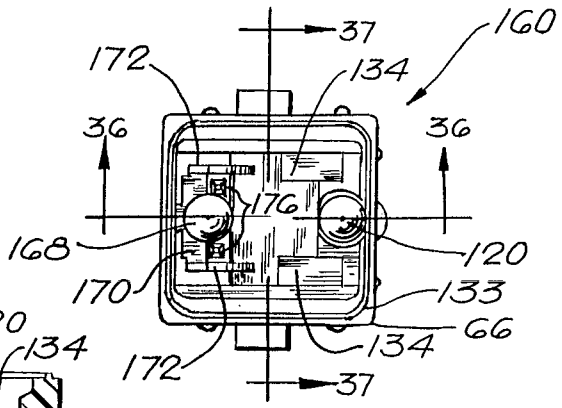
FIG. 35 is a front assembly view, showing a modified switch having an improved fixed contact construction, the view showing the front of the rear casing component with the improved contact construction mounted thereon.
Figure 36:
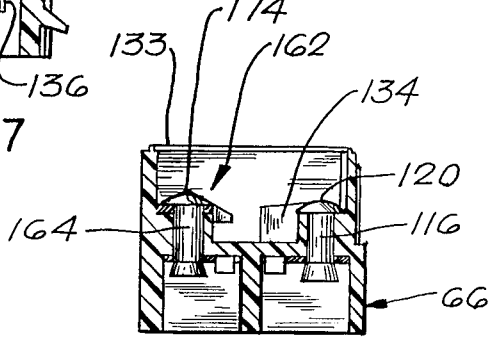
FIGS. 36 and 37 are sections, taken along the lines 36—36 and 37—37 in FIG. 35.
Figure 37:
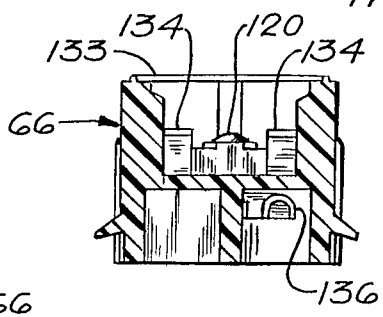
Figure 38A:
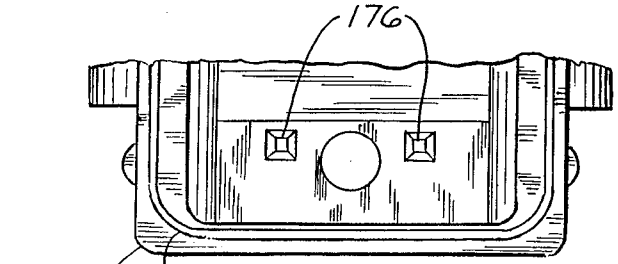
FIG. 38A is an enlarged fragmentary view, corresponding to a portion of FIG. 38.
Figure 38:
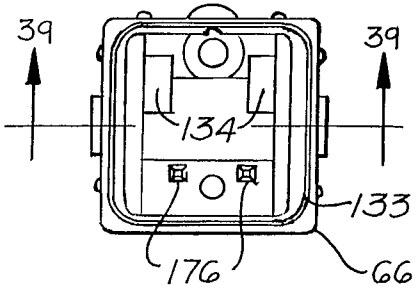
FIG. 38 is a front view of the rear casing component for the improved switch of FIG. 35.
Figure 41:
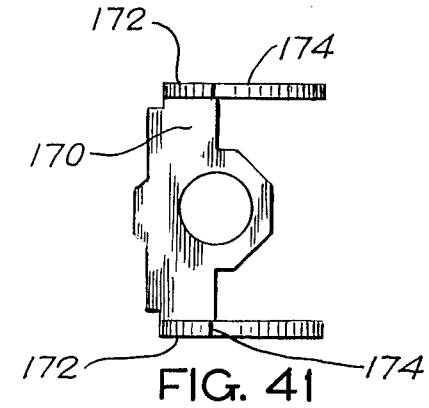
FIG. 41 is an enlarged front view of the improved fixed contact plate for the switch of FIG. 35.
Figure 42:
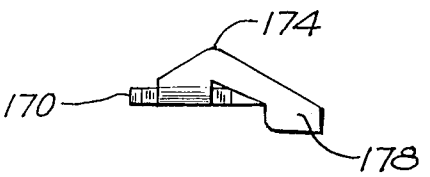
FIG. 42 is a side elevational view of the contact plate shown in FIG. 41.
Figure 43:
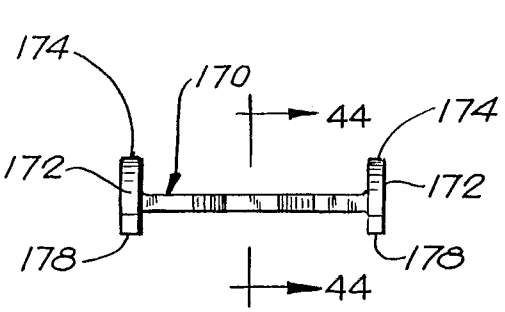
FIG. 43 is an edge view of the improved contact plate, taken in a direction at right angles to the direction of FIG. 42.
Figure 44:
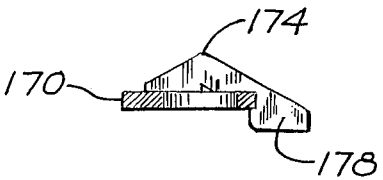
FIG. 44 is a section, taken generally along the line 44—44 in FIG. 43.

As shown in FIGS. 35 and 38, the rear casing component 66 is formed with forwardly projecting bosses 176 to assist in locating and maintaining the improved contact plate 170 in its proper orientation on the rear casing component. In addition, the contact flanges 172 have tabs or fingers 178 which project rearwardly into the central recess 128 in the rear casing component 66. The tabs 178 also assist in locating and maintaining the contact plate 170 in its proper orientation on the rear casing component 66. The contact flanges 172 are sufficiently long to insure that the corresponding J-shaped flange 112 of the contactor plate 96 will be maintained in sliding engagement with the flanges 172 throughout the entire range of movement of the contact plate 96.

The second illustrative embodiment, comprising the improved sealed toggle action electrical switch 160, shown in FIGS. 35–44, is otherwise the same as the first illustrative embodiment, comprising the switch 50, shown in FIGS. 1–34, 45 and 46.

We claim:

1. A toggle action electrical switch, comprising
a casing,
an electrically insulating resinous plastic operating lever swingable in the casing between first and second positions,
the lever having an outer arm projecting out of the casing and an inner arm projecting rearwardly into the casing,
an electrically conductive electrical contactor plate having an oversize slot for receiving the inner arm of the lever,
the oversize slot affording a loose fit with the inner arm to provide for relative swinging movement between the inner arm and the contactor plate,
a coil spring mounted around the inner arm and interposed between the lever and the contactor plate for rearwardly biasing the contactor plate,
such contactor plate being movable with the lever between first and second positions corresponding with the first and second positions of the lever,
the spring being additionally compressed by movement of the lever between its first and second positions and thereby affording a toggle action whereby the lever is alternately biased toward its first and second positons,
first and second fixed electrical contacts in the casing and slidably engageable by the contactor plate,
such contactor plate forming an electrical bridge between the first and second contacts when the plate is in its first position while not forming an electrical bridge between the contacts when the plate is in its second position,
such contactor plate including first and second rearwardly projecting J-shaped flanges thereon at opposite ends of said plate for slidably engaging the respective first and second fixed contacts,
such first fixed contact comprising a detent formation including a forwardly projecting electrically conductive protuberance for detaining the first J-shaped flange in the first and second positions of the contactor plate,
such protuberance having oppositely sloping sides for engagement by the first J-shaped flange in the first and second positions of the contactor plate,
the first J-shaped flange being deflected forwardly against the biasing action of such coil spring to produce a detent action as such first J-shaped flange passes over such protuberance during the movement of the contactor plate betweeen the first and second positions thereof, said first J-shaped flange being in continuous contact with said protuberance during movement of said first J-shaped flange between said first and second positions of said contactor plate,
the second fixed contact comprising a forwardly projecting electrically conductive contact point engageable by the second J-shaped flange when the contactor plate is in its first position,
and a pair of electrically insulating ramps sloping forwardly on such casing and adjacent such contact point on opposite sides thereof for slidable engagement by the second J-shaped flange to hold the second J-shaped flange out of engagement with the contact point in the second position of the contactor plate,
whereby the second J-shaped flange engages the contact point in the first position of the contactor plate while engaging the insulating ramps in the second position of the contactor plate.

2. A toggle action electrical switch according to claim 1, in which such forwardly projecting electrically conductive protuberance comprises an additional contact point having oppositely sloping sides for engagement by the first J-shaped flange in the first and second positions of the contactor plate.

3. A toggle action electrical switch according to claim 1, in which such first fixed contact comprises an electrically conductive fixed contact flange member,
such protuberance and another similar protuberance being formed by a pair of forwardly projecting flanges on such fixed contact flange member,
such forwardly projecting flanges having forwardly projecting humps thereon slidably engageable by the first J-shaped flange,
each of such humps having oppositely sloping side portions for engagement by the first J-shaped flange in the first and second positions of the contactor plate,
the first J-shaped flange being slidable over such humps in moving with the contactor plate between its first and second positions,
such humps and such first J-shaped flange affording a detent action for detaining the contactor plate in its first and second positions.

4. A toggle action electrical switch, comprising
a casing,
an electrically insulating resinous plastic operating lever swingable in the casing between first and second positions,
the lever having an outer arm projecting out of the casing and an inner arm projecting rearwardly into the casing,
an electrically conductive electrical contactor plate having an oversize slot for receiving the inner arm of the lever,
the oversize slot affording a loose fit with the inner arm to provide for relative swinging movement between the inner arm and the contactor plate,
a coil spring mounted around the inner arm and interposed between the lever and the contactor plate for rearwardly biasing the contactor plate,
such contactor plate being movable with the lever between first and second positions corresponding with the first and second positions of the lever,
the spring being additionally compressed by movement of the lever between its first and second positions and thereby affording a toggle action whereby the lever is alternately biased toward its first and second positions,
first and second fixed electrical contacts in the casing and slidably engageable by the contactor plate,
such contactor plate forming an electrical bridge between the first and second contacts when the plate is in its first position while not forming an electrical bridge between the contacts when the plate is in its second position,
such contactor plate including first and second rearwardly projecting J-shaped flanges thereon at opposite ends of said plate for slidably engaging the respective first and second fixed contacts,
such first fixed contact comprising an electrically conductive fixed contact plate including a pair of forwardly projecting flanges for sliding engagement by the first J-shaped flange on the contactor plate, such forwardly projecting flanges having forwardly projecting humps for detaining the first J-shaped flange in the first and second positions of the contactor plate, each of such humps having oppositely sloping portions for engagement by the first J-shaped flange in the first and second positions of the contactor plate, the first J-shaped flange being deflected forwardly against the biasing action of such coil spring to produce a detent action as such first J-shaped flange passes over such humps during the movement of the contactor plate between the first and second positions thereof, said first J-shaped flange being in continuous contact with said pair of forwardly projecting flanges during movement of said first J-shaped flange between said first and second positions of said contactor plate, the second fixed contact comprising a forwardly projecting electrically conductive contact point engageable by the second J-shaped flange when the contactor plate is in its first position, and a pair of electrically insulating ramps sloping forwardly on such casing and adjacent such contact point on opposite sides thereof for slidable engagement by the second J-shaped flange to hold the second J-shaped flange out of engagement with the contact point in the second position of the contactor plate, whereby the second J-shaped flange engages the contact point in the first position of the contactor plate while engaging the insulating ramps in the second position on the contactor plate.

* * * * *